United States Patent [19]

Watanabe et al.

[11] Patent Number: 4,803,516

[45] Date of Patent: Feb. 7, 1988

[54] COLOR IMAGE FORMING APPARATUS WITH COLOR INFORMATION DETECTION

[75] Inventors: Junji Watanabe; Hirobumi Kessoku, both of Yokohama, Japan

[73] Assignee: Kabushiki Kaisha Toshiba, Kawasaki, Japan

[21] Appl. No.: 66,555

[22] Filed: Jun. 26, 1987

[30] Foreign Application Priority Data

Jun. 30, 1986 [JP] Japan ..... 61-153527

[51] Int. Cl.[4] ..... G03G 15/01

[52] U.S. Cl. ..... 355/4; 355/6

[58] Field of Search ..... 355/4, 3 DD, 14 D, 6, 355/7, 14 R, 8

[56] References Cited

U.S. PATENT DOCUMENTS

| | | | |
|---|---|---|---|
| 4,494,862 | 1/1985 | Tanaka | 355/40 X |
| 4,660,949 | 4/1987 | Saito et al. | 354/21 |
| 4,690,543 | 9/1987 | Watanabe | 355/4 |
| 4,695,154 | 9/1987 | Watanabe | 355/8 |
| 4,710,016 | 12/1987 | Watanabe | 355/4 |
| 4,711,553 | 12/1987 | Watanabe | 355/14 R X |

FOREIGN PATENT DOCUMENTS 53-131048 11/1978 Japan ..... 355/6

OTHER PUBLICATIONS

*Research Disclosure,* Jul. 1979, No. 183, Elwin, Warren G., "Coding Documents with Adjustable Copier Parameters", p. 389.

*Primary Examiner*—Arthur T. Grimley
*Assistant Examiner*—J. Pendegrass
*Attorney, Agent, or Firm*—Foley & Lardner, Schwartz, Jeffery, Schwaab, Mack, Blumenthal & Evans

[57] ABSTRACT

An image forming apparatus includes an optical system for forming a latent image corresponding to an image of a document placed on a document table and a plurality of developing units for developing the latent image using toners having different colors. An automatic document feeder is arranged on the document table to automatically set the document on the document table. A spot sensor is arranged on the automatic document feeder to detect developing color information representing which color is used to develop the latent image. One of the developing units is selected on the basis of a detection result of the spot sensor.

14 Claims, 17 Drawing Sheets

COLOR IMAGE FORMING APPARATUS WITH COLOR INFORMATION DETECTION

BACKGROUND OF THE INVENTION

The present invention relates to an image forming apparatus such as an electronic copying machine.

In recent years, color copying machines have been developed. In such a color copying machine, a plurality of developing units are arranged to develop a latent image with toners of different colors. One of the developing units can be selected to develop a latent image, thereby obtaining a copy of the image of a desired color.

In a conventional color copying machine, to select a color of an image to be formed, selection switches arranged in, e.g., an operation panel must be operated to select a desired developing unit. For this reason, color copying operations are time-consuming and cumbersome.

SUMMARY OF THE INVENTION

It is an object of the present invention to provide an image forming apparatus wherein operability of color copying can be improved.

According to an aspect of the present invention, there is provided an image forming apparatus which comprises latent image forming means for forming a latent image corresponding to an image of a document, a plurality of developing means for developing the latent image using different color agents, detecting means for detecting developing-color information which is provided on the document and represents one of the color agents to be used for developing the latent image, and selecting means for selecting one of said plurality of developing means on the basis of the developing color information.

With the above arrangement, when developing color information marked on a document is detected by a detecting means, the corresponding developing means is selected and is used for development, thereby automatically forming a color image.

DETAILED DESCRIPTION OF THE PREFERRED EMBODIMENTS

Figure 1:
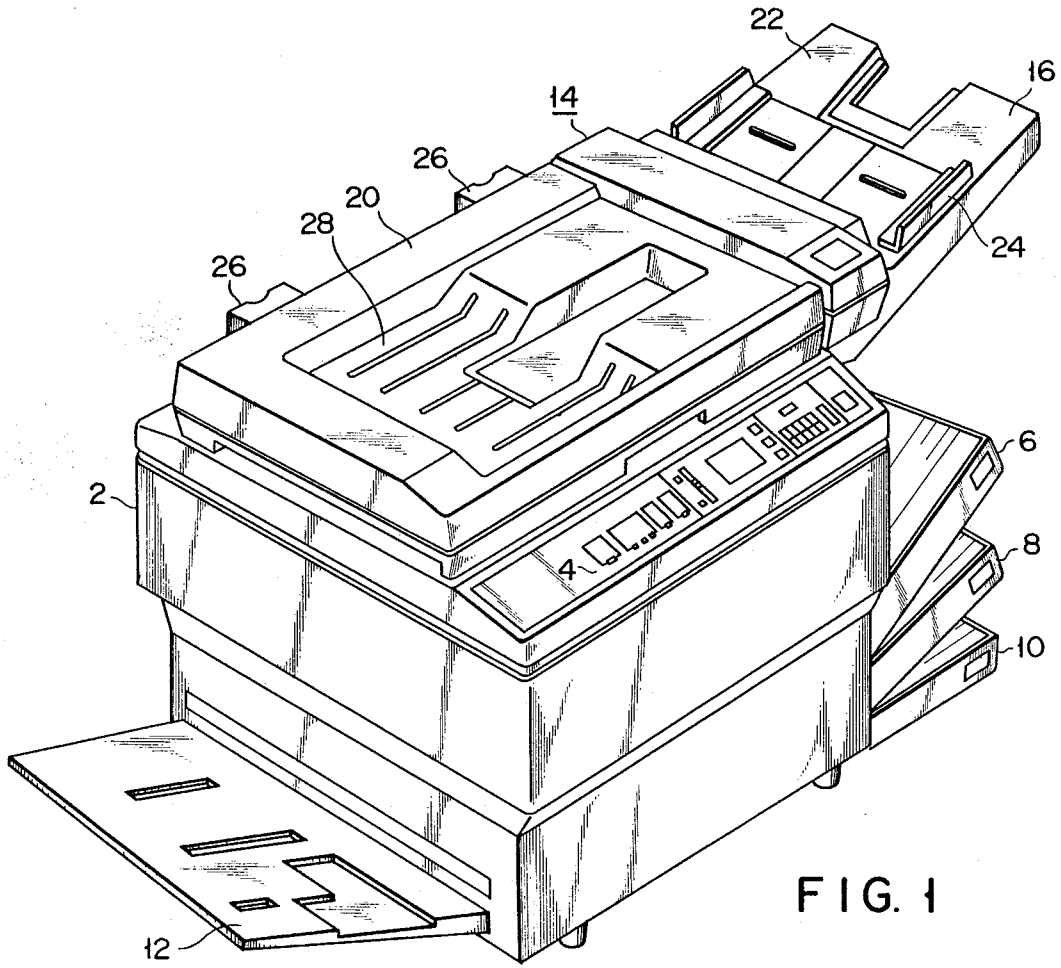
FIG. 1 is a perspective view of an image forming apparatus according to a first embodiment of the present invention.

FIGS. 1 to 10B show a first embodiment of the present invention. Referring to FIG. 1, reference numeral 2 denotes a housing of a copying machine as an image forming apparatus according to the present invention. Operation panel 4 is arranged at the upper front portion of housing 2. Upper, middle, and lower paper cassettes 6, 8, and 10 are detachably mounted in the lower portion of the side wall of housing 2. Automatic document feeder 14 is mounted on housing 2. Feeder 14 comprises feed unit 16 for feeding documents and convey unit 20 for conveying a document and setting it onto document table 18. Feed unit 16 has work table 22 on which a document is placed, and document guide 24 for guiding the document. The rear portion of convey unit 20 is pivotally supported on the upper rear portion of housing 2 through a pair of pivot shafts 26. Feed unit 20 can be opened or closed with respect to document table 18. Document stacker 28 is formed on the upper surface of convey unit 20. The documents from table 18 are stacked one by one on stacker 28.

Figure 2:
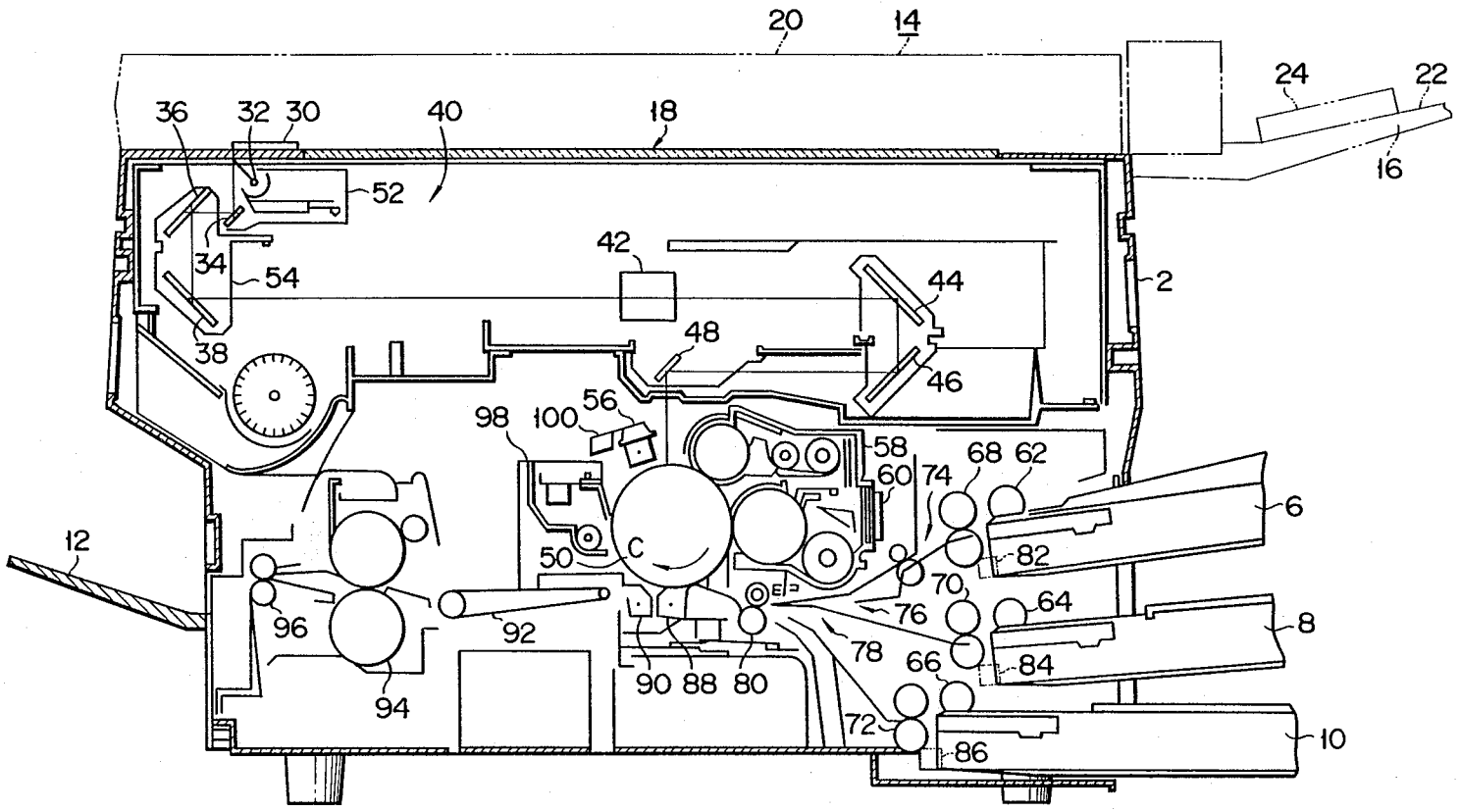
FIG. 2 is a longitudinal sectional front view of the image forming apparatus shown in FIG. 1.

As shown in FIG. 2, document table 18 made of a transparent glass plate is formed on the upper surface of housing 2 to support the document. Stationary scale 30 is formed at one side of document table 18 and serves as a reference for setting the document. The document set along scale 30 of table 18 is exposed and scanned with light upon reciprocal movement of optical system 40 along the lower surface of table 18. Optical system 40 includes exposure lamp 32, and mirrors 34, 36, and 38. Light reflected by the document upon scanning of optical system 40, i.e., light reflected by the document upon radiation by exposure lamp 32 is continuously reflected by mirrors 34, 36, and 38. The reflected light passes through magnification conversion lens 42 and is then reflected by mirrors 44, 46, and 48. The reflected light is focused on the surface of photosensitive drum 50. Lamp 32 and mirror 34 are mounted on first carriage 52. Mirrors 36 and 38 are mounted on second carriage 54. Second carriage 54 is moved at ½ the speed of first carriage 52 so as to obtain a constant optical path length between the document and drum 50.

Photosensitive drum 50 is rotated in a direction of arrow c, and the surface of drum 50 is charged by charger 56. The charged surface of drum 50 is exposed with light, and then a latent image is formed thereon. The latent image is developed by first or second developing unit 58 or 60.

Sheets are selectively picked up from upper, middle, and lower paper cassettes 6, 8 and 10 by respective paper pickup rollers 62, 64, and 66 and respective paper feed roller pairs 68, 70, and 72 one by one. The picked up sheet is fed to register roller pair 80 through a corresponding one of paper guide paths 74, 76, and 78 and is aligned thereat. Thereafter, the sheet is fed to a transfer unit. The sizes of paper cassettes 6, 8, and 10 are respectively detected by cassette size detection switches 82, 84, and 86. Switches 82, 84, and 86 comprise a plurality of microswitches which are turned on/off upon insertion of cassettes having different sizes.

The sheet fed to the transfer unit is brought into tight contact with the surface of photosensitive drum 50 at a position opposite to transfer charger 88. In this state, a toner image on drum 50 is transferred to the sheet by charger 88. The sheet transferred with the toner image is electrostatically separated from drum 50 by separation charger 90. The separated sheet is conveyed to fixing roller pair 94 by conveyor belt 92. When the sheet passes through roller pair 94, the transfer image is fixed on the sheet. After the toner image is fixed on the sheet, the sheet is discharged by discharge roller pair 96 onto tray 12 outside housing 2.

The residual toner particles on the surface of photosensitive drum 50 upon completion of toner image transfer are removed by cleaner 98. The charge left on the surface of drum 50 is discharged by discharge lamp 100, thereby restoring the initial state of drum 50.

Figure 3:
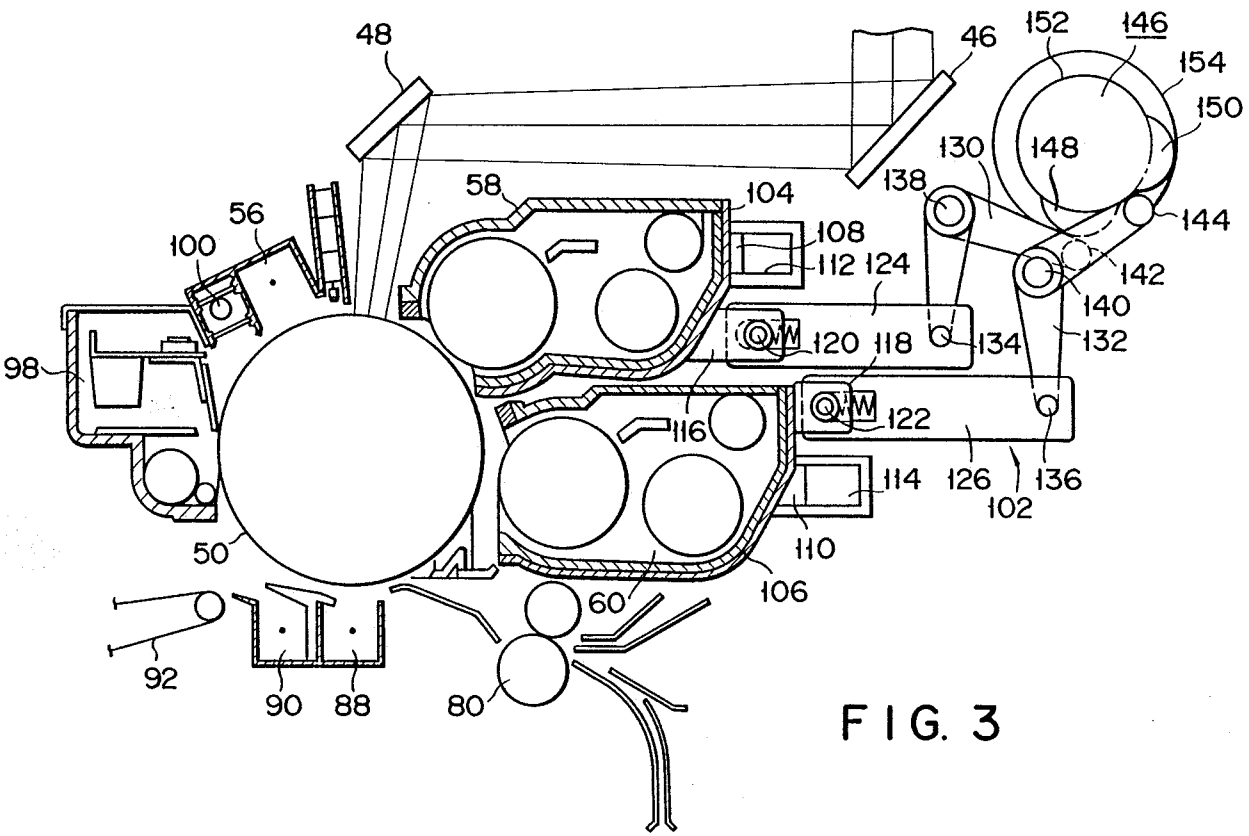
FIG. 3 is a sectional view of a selector mechanism for developing units in the image forming apparatus shown in FIG. 1.
Figure 4:
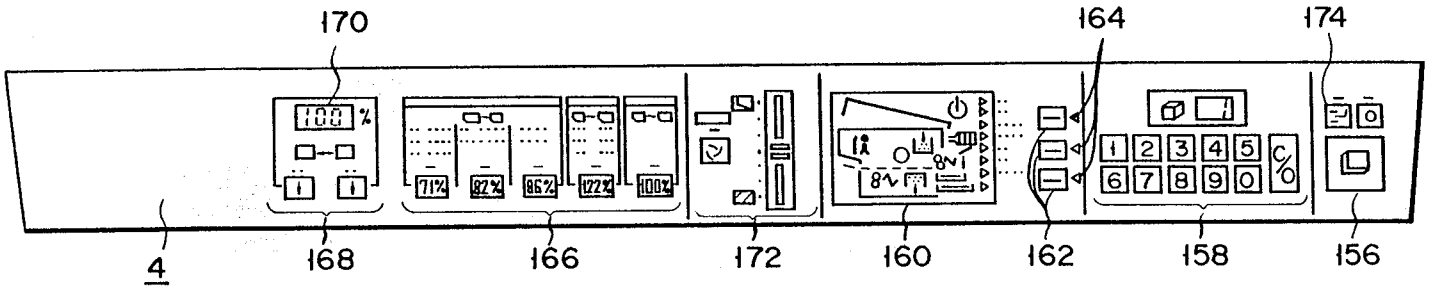
FIG. 4 is a front view of an operation panel in the image forming apparatus shown in FIG. 1.

First developing unit 58 stores a black toner, and second developing unit 60 stores a toner having a color (e.g., red) except for black. One of developing units 58 and 60 is selected by selector mechanism 102, as shown in FIG. 3 and is used for development. Mechanism 102 comprises first and second holding members 104 and 106 for respectively moving developing units 58 and 60 toward the front side in housing 2. More specifically, holding member 104 detachably holds developing unit 58 which stores the black toner, and holding member 106 detachably holds developing unit 60 which stores the red toner or a supplementary developing unit for storing a toner having a color different from red. Members 108 and 110 (only the rear members 108 and 110 are illustrated) are mounted on the rear and front sides of first and second holding members 104 and 106. Members 108 and 110 are respectively guided by guide rails 112 and 114 mounted on housing 2. Therefore, first and second developing units 58 and 60 can come close to drum 50 or can be separated therefrom by the above mechanism. Connecting pieces 116 and 118 are respectively mounted on first and second holding members 104 and 106. Connecting pieces 116 and 118 are connected to first ends of arms 124 and 126 through shafts 120 and 122. The second ends of arms 124 and 126 are coupled to first ends of levers 130 and 132 through shafts 134 and 136, respectively. The intermediate portions of levers 130 and 132 are pivotally supported by shafts 138 and 140. Cam followers 142 and 144 are mounted on the second ends of levers 130 and 132, respectively. Cam followers 142 and 144 are designed to engage with large-diameter portions 148 and 150 of cam 146, respectively. When cam follower 142 is engaged with large-diameter portion 148, cam follower 144 is engaged with small-diameter portion 152. When cam follower 144 is engaged with large-diameter portion 150, cam follower 142 is engaged with small-diameter portion 152. In this state, motor 154 drives cam 146. When cam follower 142 is engaged with large-diameter portion 148, first developing unit 58 comes close to photosensitive drum 50 and second developing unit 60 is separated therefrom. When cam follower 144 is engaged with large-diameter portion 150, developing unit 60 comes close to drum 50 and developing unit 58 is separated therefrom Operation panel 4 arranged on housing 2 includes copying key 156 for designating the start of copying, ten-key pad 158 for setting the number of sheets to be copied, display 160 for displaying operating states of the components, paper jam, and the like, cassette selection keys 162 for respectively selecting upper, middle, and lower paper cassettes 6, 8, and 10, cassette indicators 164 designed for indicating a selected one of cassettes 6, 8, and 10, magnification keys 166 for setting enlargement and reduction ratios in copying according to predetermined relationships, zoom keys 168 for continuously changing the magnification, magnification display 170 for displaying a preset magnification, density setting unit 172 for setting a desired copying density, mode selection keys 174 for respectively designating the automatic document feed mode and the normal mode which are selectively set.

Figure 5:
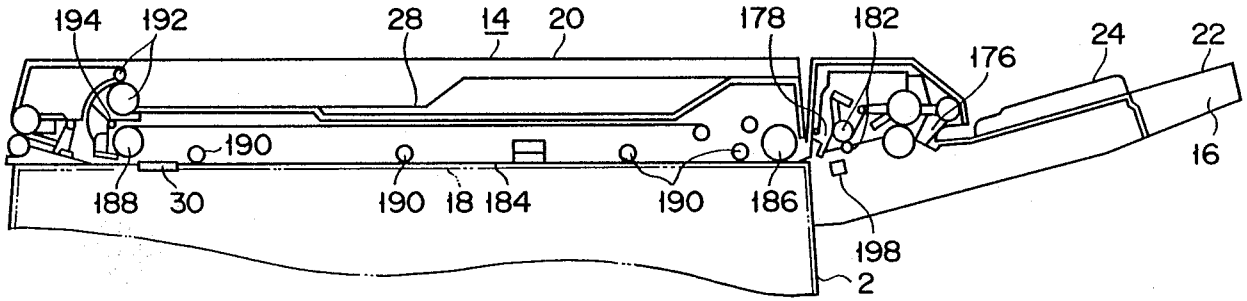
FIG. 5 is a longitudinal sectional front view of an automatic document feeder in the image forming apparatus shown in FIG. 1.

As shown in FIG. 5, document sensor 176 and size sensor 178 are arranged in feed unit 16 of automatic document feeder 14. Document sensor 176 detects a document guided by guide 24. Size sensor 178 detects the size of a document fed from a given cassette. When the document is detected by sensor 176, a pair of separation rollers 180 and a pair of aligning rollers 182 are driven. The documents are separated by separation rollers 180 one by one. The document is aligned by rollers 182 and fed to convey unit 20. Conveyor belt 184 is arranged in convey unit 20 to convey the document fed from feed unit 16. Belt 184 is looped between driving pulley 186 and driven pulley 188. Conveyor belt 184 is urged by a plurality of press rollers 190 against document table 18. Upon driving of conveyor belt 184 in synchronism with feed unit 16, the document fed from feed unit 16 is conveyed onto table 18. The leading end of the document abuts against stationary scale 30, and the document is set in a predetermined position. In this state, the document is subjected to copying. When copying is completed, scale 30 is inclined and the pair of discharge rollers 192 are driven end belt 184 is driven again. As a result, the document is discharged from table 18 to document stacker 28. Reference numeral 194 denotes a sensor for detecting paper jam.

Figure 6:
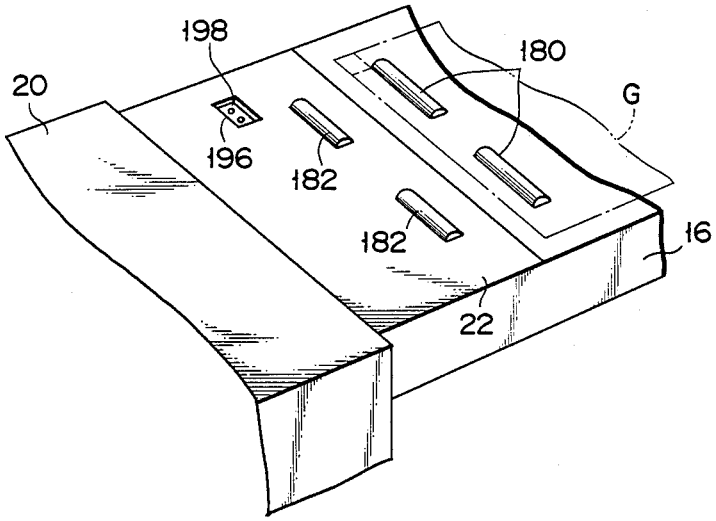
FIG. 6 is a perspective view of a spot sensor arranged in the automatic document feeder shown in FIG. 4.
Figure 7:
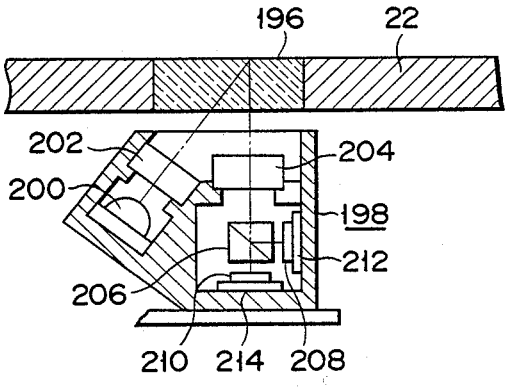
FIG. 7 is a longitudinal sectional side view of a spot sensor shown in FIG. 6.

Window 196 is formed near aligning rollers 182 in feed unit 16, as shown in FIGS. 6 and 7. Spot sensor 198 is arranged at a position face to window 196 in feed unit 16. Spot sensor 198 comprises light-emitting diode 200. Light emitted from diode 200 is condensed by lens 202 and passes through window 196. The light is then incident on the surface of document G. Light reflected by document G passes again through window 196 and is condensed by lens 204. The light is then guided to half mirror 206. Light is split by half mirror 206 into two beams. These beams pass through filters 208 and 210 and are detected by, e.g., first and second CCD line sensors 212 and 214, respectively. The beams passing through filters 208 and 210 have different wavelengths. For example, filter 208 transmits only gray light therethrough and filter 210 transmits only blue light therethrough. There are four detection results of color information CD marked on the document. Information CD is detected by both first line sensors 212 and 214. Information CD is detected by first line sensor 212 but not by second line sensor 214. Information CD is detected by second line sensor 214 but not by first line sensor 212. Information CD is detected by neither first line sensor 212 nor second line sensor 214.

Figure 8:
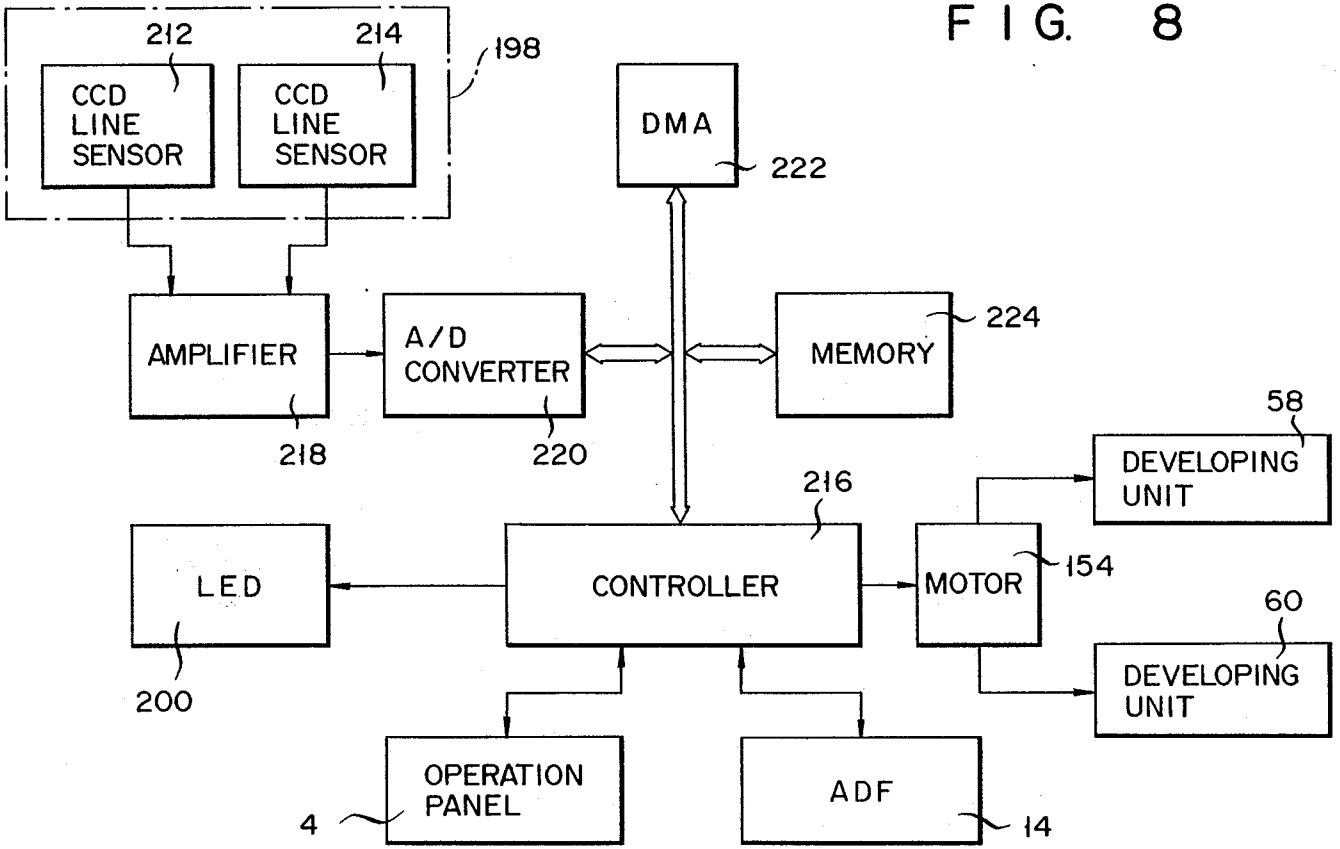
FIG. 8 is a block diagram of a control circuit in the image forming apparatus shown in FIG. 1.

Reference numeral 216 in FIG. 8 denotes a controller for controlling the overall operations of the copying machine. Controller 216 comprises, for example, a microcomputer. Controller 216 is electrically connected to operation panel 4, motor 154 for selecting first and second developing units 58 and 60, and automatic document feeder 14. Controller 216 is also electrically connected to light-emitting diode 200 and first and second CCD line sensors 212 and 214. Output signals from sensors 212 and 214 are amplified by amplifier 218, and the amplified signals are supplied to A/D converter 220. An output signal from A/D converter 220 is stored in memory 224 through DMA (Direct Memory Access) 222. Data stored in memory 224 is processed by controller 216 in a manner to be described later.

The operation of the arrangement described above will be described with reference to FIG. 9.

In step ST1, controller 216 determines whether copying key 156 is depressed. If YES in step ST1, the flow advances to step ST2.

In step ST2, controller 216 determines according to an output from document sensor 176 whether the document is present on work table 22 of automatic document feeder 14. If NO in step ST2, the flow is ended. However, if YES in step ST2, the flow advances to step ST3.

In step ST3, separation rollers 180 and aligning rollers 182 are operated to initiate feeding of the document, and the flow advances to step ST4.

In step ST4, developing color information CD of the fed document is read by spot sensor 198. More specifically, light-emitting diode 200 is turned on, and light from diode 200 is incident on the document through lens 202 and window 196. Light reflected by the document is incident on the document surface on work table 22 through window 196. The incident light passes through lens 204, half mirror 206, and filters 208 and 210 and is guided to first and second CCD line sensors 212 and 214. Photoelectric output signals from line sensors 212 and 214 are amplified by amplifier 218 and the amplified signals are supplied to A/D converter 220 and converted into digital signals. The digital signals are stored in different memory areas of memory 224 through DMA 222. When the document reaches stationary scale 30 of document table 18, the flow advances to step ST5.

Figure 10A:
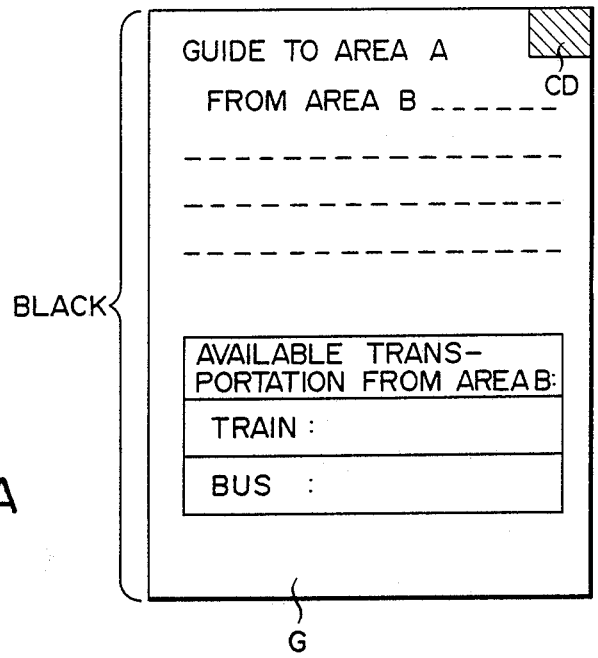
FIGS. 10A and 10B are views for explaining functioning of the image forming apparatus shown in FIG. 1.

In step ST5, light-emitting diode 200 is turned off and controller 216 determines on the basis of image information stored in memory 224 whether developing color information CD is marked on the document image. For example, an addition or subtraction between the two pieces of information stored in memory 224 is performed to detect information CD. Controller 216 determines according to this detection whether information CD is marked on the document image. As shown in FIG. 10A, if developing color information CD is marked on document G, the flow advances to step ST6. Otherwise, the flow advances to step ST7.

In step ST6, second developing unit 60 which stores, e.g., a red toner is selected so as to perform color copying. Thereafter, the flow advances to step ST8.

In step ST7, first developing unit 58 which stores the black toner is selected. The flow then advances to step ST8.

Figure 10B:
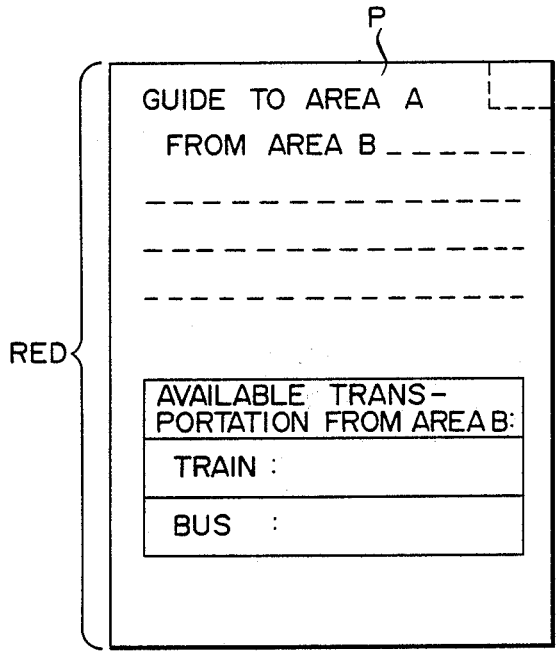

In step ST8, if second developing unit 60 which stores the red toner has been selected, copying using unit 60 is performed. In this case, as shown in FIG. 10B, an image of document G shown in FIG. 10B is formed on sheet p with the red toner. Developing color information CD marked on document G has blue, i.e., a color having a wavelength which provides higher sensitivity of drum 50. Therefore, information CD is not formed together with the image on the sheet. If first developing unit 58 which stores the black toner is selected, copying using unit 58 is performed. In this case, normal copying is performed. Upon completion of copying, the flow returns to step ST2.

With the above arrangement, when the presence of developing color information on the document is detected by spot sensor 198, second developing unit 60 which stores the toner having a color different from black is selected, and color copying is performed. Therefore, when the operator sets a document in feed unit 16 of automatic document feeder 14 and depresses copying key 156, color copying is performed. Therefore, operability can be greatly improved as compared with operations in a conventional color copying machine.

Since spot sensor 198 is arranged in feed unit 16 of automatic document feeder 14, developing color information CD can be detected upon setting of the document on document table 18. Therefore, a time required between detection of developing color information CD and the start of copying can be shortened.

Since spot sensor 198 is arranged in automatic document feeder 14, the arrangement in housing 2 of the copying machine need not be substantially modified. Spot sensor 198 is compact, and the overall configuration of the apparatus cannot be bulky.

A second embodiment of the present invention will be described with reference to FIGS. 11 and 12.

In the first embodiment, spot sensor 198 is arranged in automatic document feeder 14. However, in the second embodiment, spot sensor 198 is arranged in optical system 40.

Figure 11:
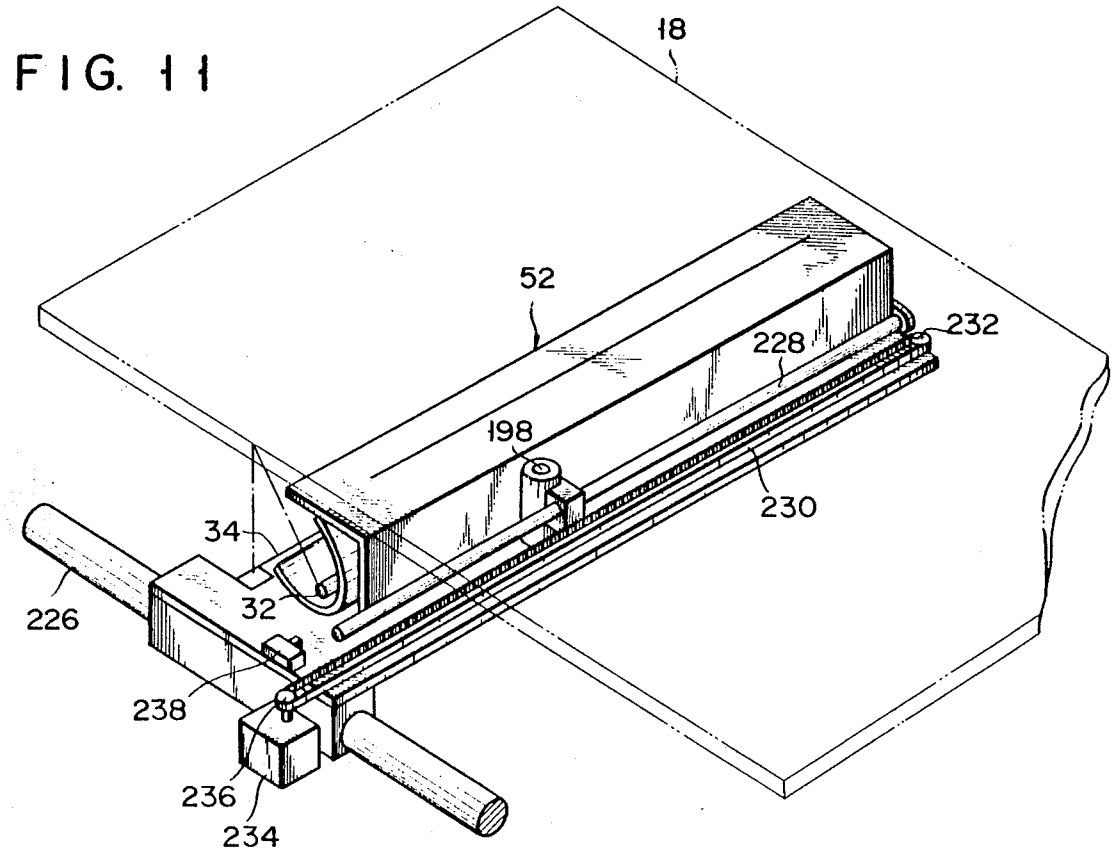
FIG. 11 is a perspective view of a spot sensor used in an image forming apparatus according to a second embodiment of the present invention.

Referring to FIG. 11, one end of first carriage 52 for supporting lamp 32 and mirror 34 is supported by shaft 226. The other end of carriage 52 is supported by a guide rail (not shown). Carriage 52 can be reciprocated along shaft 226. Guide shaft 228 is located at a light-shielding portion of carriage 52 along lamp 32. The light-shielding portion is designed to shield light from lamp 32. Spot sensor 198 is movably supported by guide shaft 228. Spot sensor 198 is coupled to timing belt 230 extending along guide shaft 228. Belt 230 is looped between driven pulley 232 and driving pulley 236 fixed on the rotating shaft of pulse motor 234. When pulse motor 234 is rotated, spot sensor 198 is moved in a direction perpendicular to the scanning direction of first carriage 52. Position sensor 238 of a microswitch is arranged at the side of pulse motor 234 on carriage 52 to detect the home position of spot sensor 198. When a power switch of copying machine is turned on, spot sensor 198 is brought into contact with position sensor 238, thereby detecting the home position of spot sensor 198. Other arrangements of the second embodiment are the same as those of the first embodiment.

The operation of the second embodiment will be described below.

Figure 12:
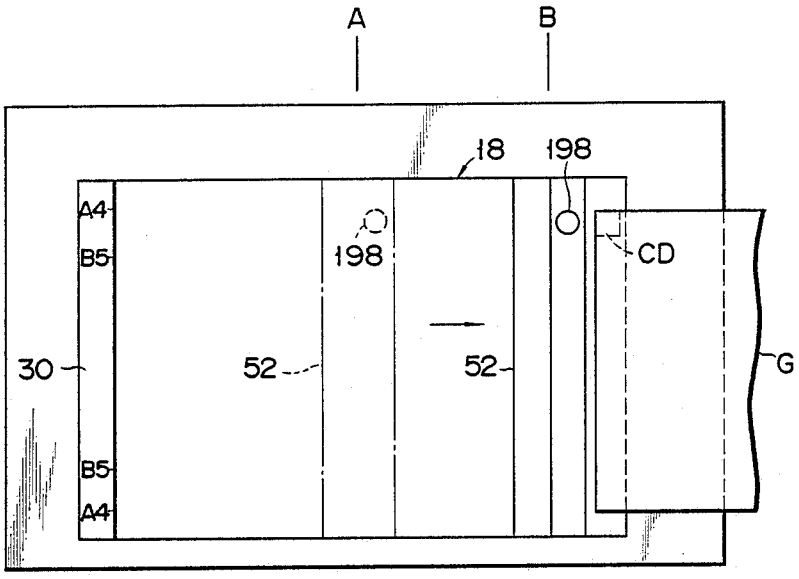
FIG. 12 is a view for explaining functioning of the image forming apparatus using the spot sensor shown in FIG. 11.

As shown in FIG. 12, first carriage 52 waits at position A representing an image formation area corresponding to the selected paper size. Position A is substantially the center of document table 18. Spot sensor 198 has moved in advance to position A corresponding to developing color information CD marked on document G.

In this state, document G is set in automatic document feeder 14 and is detected by document sensor 176 in the same manner as in the first embodiment. In this state, feeding of document G is initiated. At the same time, first carriage 52 is moved to and stopped at position B (FIG. 12) of document table 18 on the feed unit 16 side of feeder 14. In this position, light-emitting diode 200 of spot sensor 198 is turned on, and developing color information CD of document G is detected. The subsequent operations are the same as those described above with reference to the first embodiment. That is, the document image is copied.

With the above arrangement, the same effect as in the first embodiment can be obtained.

A third embodiment of the present invention will be described with reference to FIGS. 13 to 16.

In the second embodiment, developing color information CD of document G fed by automatic document feeder 14 is detected by spot sensor 198 arranged on first carriage 52. However, in the third embodiment, detection of developing color information CD will be described in both the automatic feed mode and the normal mode, i.e., when automatic document feeder 14 is used and when feeder 14 is not used (the operator manually places document G on document table 18).

Figure 13:
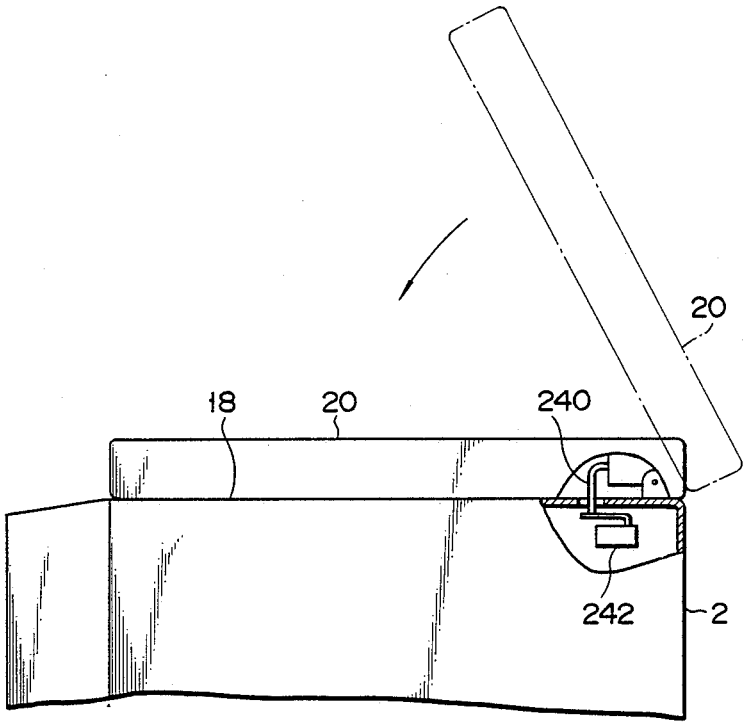
FIG. 13 is a view of a spot sensor used in an image forming apparatus according to a third embodiment of the present invention.

Convey unit 20 in automatic document feeder 14 can be opened or closed with respect to document table 18, as shown in FIG. 13. Actuator 240 is arranged near the pivotal center of convey unit 20 and can be inserted inside housing 2. Opening/closing detection switch 242 is arranged inside housing 2 and is designed to be operated by actuator 240. When convey unit 20 is open with respect to document table 18, switch 242 is kept off. However, when convey unit 20 is closed on table 18, switch 242 is kept on by means of actuator 240. Other arrangements of the third embodiment are the same as those of the second embodiment.

The operation of the third embodiment will be described below.

Figure 15:
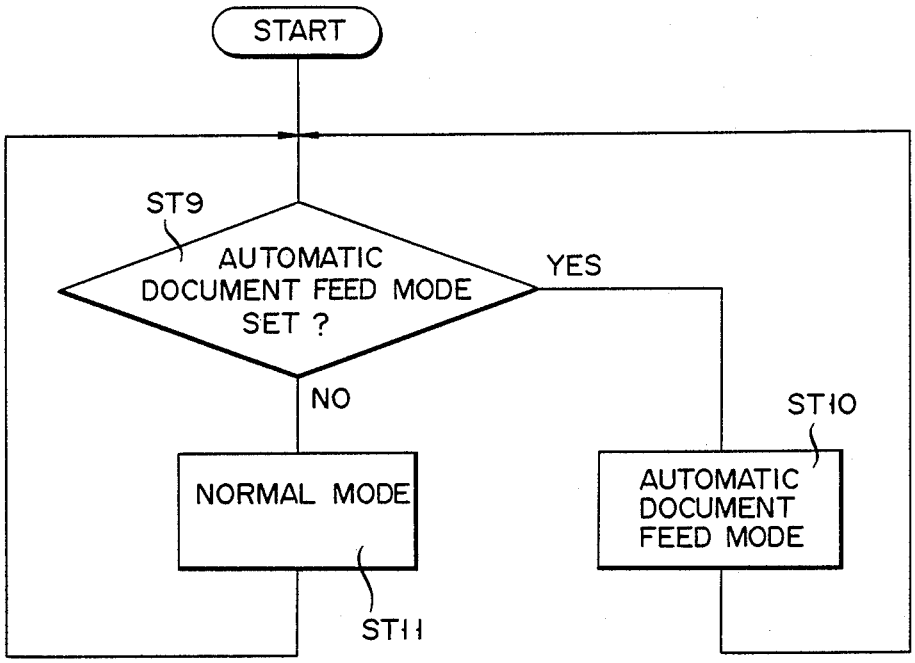
FIG. 15 is a flow chart for explaining the operation of the image forming apparatus shown in FIG. 13.

In step ST9, referring to FIG. 15, controller 216 determines in response to an output from mode selection key 174 whether the automatic document feed mode is set. If YES in step ST9, the flow advances to step ST10. However, if NO in step ST9, the flow advances to step ST11.

Figure 9:
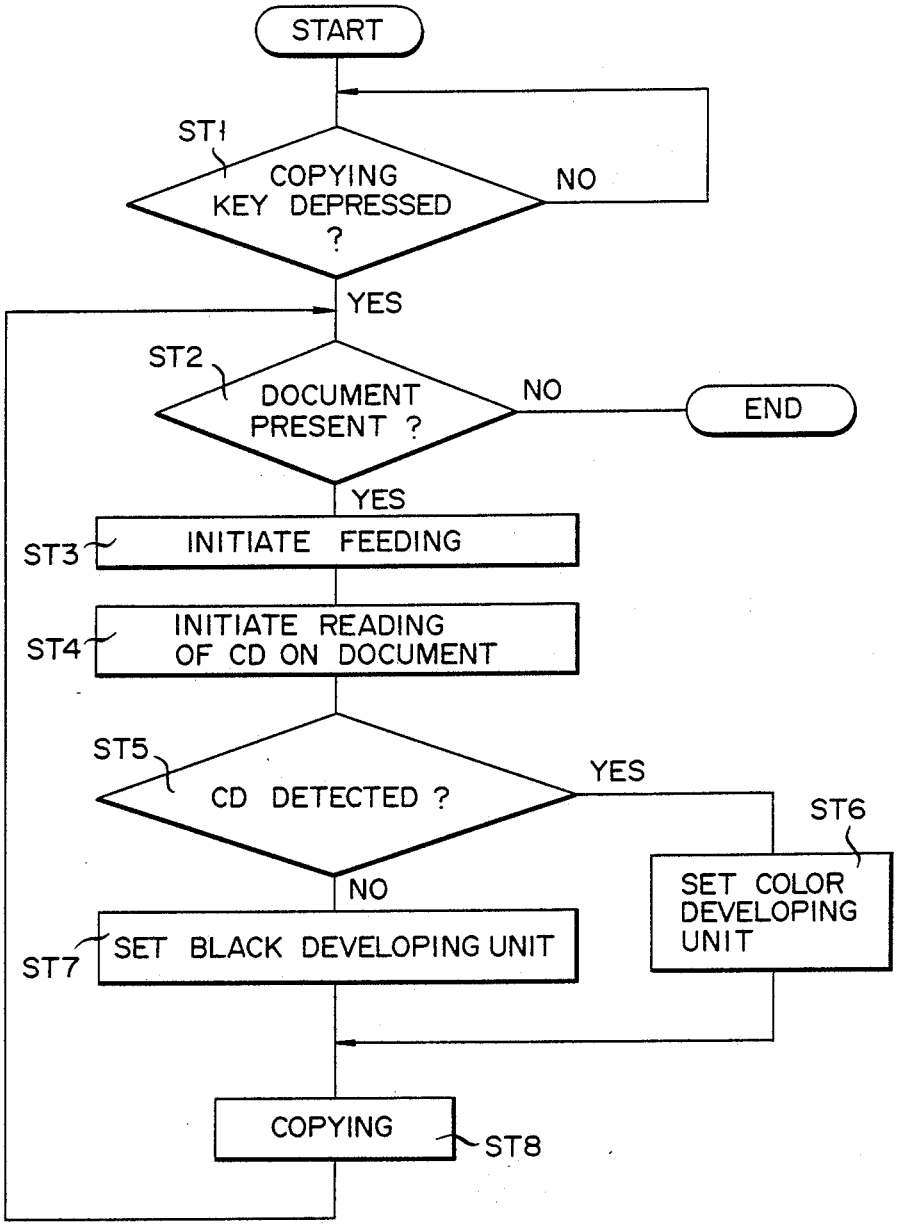
FIG. 9 is a flow chart showing an operation of the image forming apparatus shown in FIG. 1.

In step ST10, the automatic document feed mode shown in FIG. 9 is performed.

Figure 16:
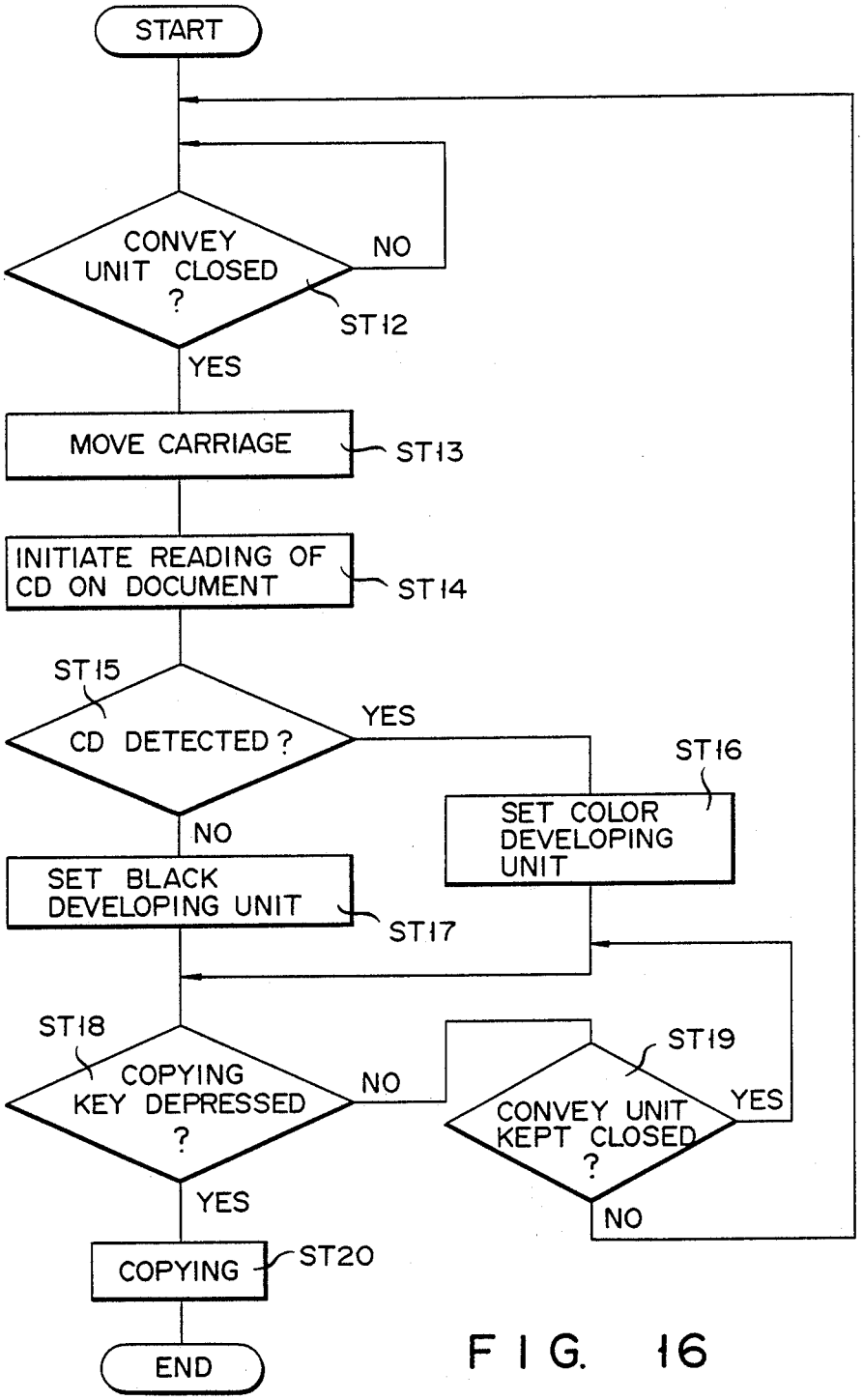
FIG. 16 is a flow chart showing the normal mode in the flow chart shown in FIG. 15.
Figure 17:
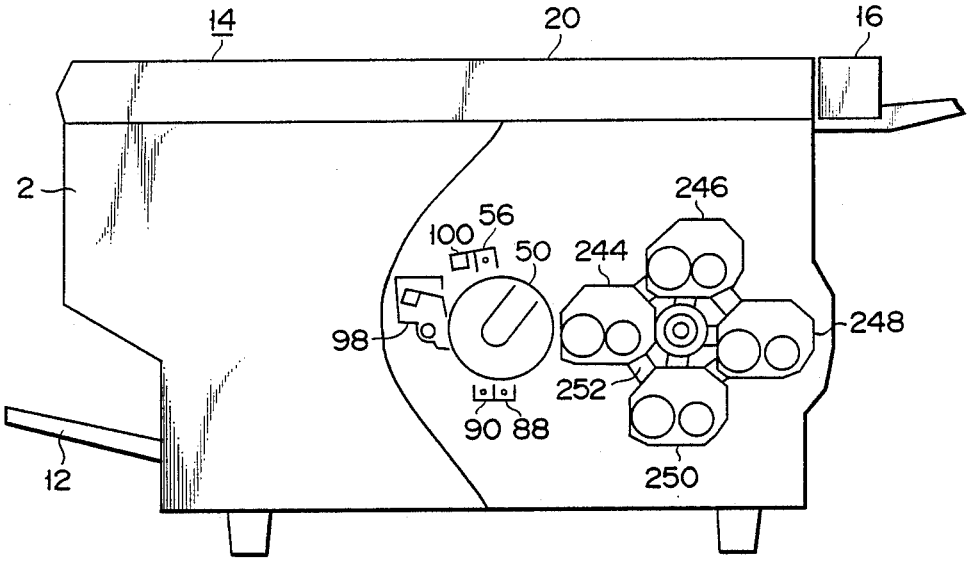
FIG. 17 is a view showing an image forming apparatus according to a fourth embodiment of the present invention.

In step ST11, the normal mode shown in FIG. 16 is performed.

In step ST12 of the normal mode, the document is set along stationary scale 30 of document table 18, and the convey unit 20 is closed, as indicated by the solid line in FIG. 13. Opening/closing detection switch 242 is turned on by means of actuator 240, which is then signaled to controller 216. In this state, the flow advances to step ST13.

Figure 14:
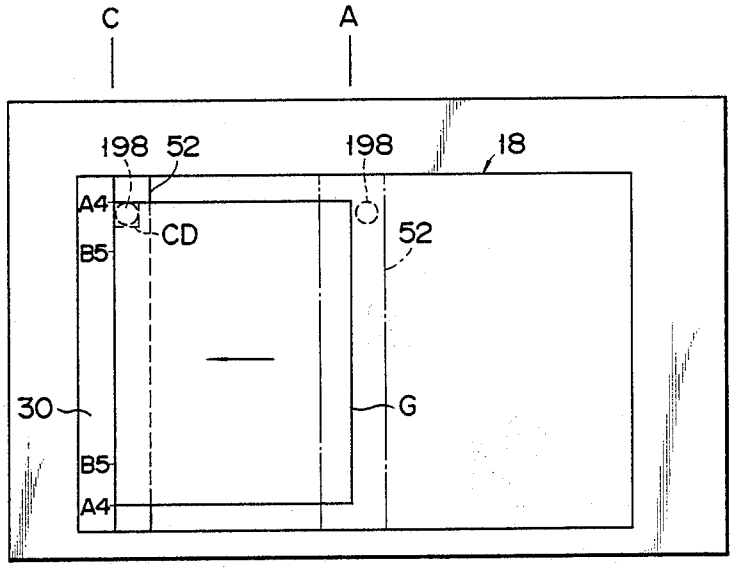
FIG. 14 is a front view for explaining functioning of the image forming apparatus using the spot sensor shown in FIG. 13.

In step ST13, first carriage 52 is moved from home position A to position C near stationary scale 30, as shown in FIG. 14. The flow then advances to step ST14.

In step ST14, light-emitting diode 200 of spot sensor 198 is turned on, and reading of developing color information CD of document G set on document table 18 is initiated. The flow then advances to step ST15.

In step ST15, light-emitting diode 200 is turned off. Controller 216 determines whether information CD is marked on the document image according to the reading result. If YES in step ST15, the flow advances to step ST16. Otherwise, the flow advances to step ST17.

In step ST16, second developing unit 60 which stores the red toner is selected for color copying. The flow then advances to step ST18.

In step ST17, first developing unit 58 which stores the black toner is selected. The flow then advances to step ST18.

In sep ST18, controller 216 determines whether copying key 156 is depressed. If NO in step ST18, the flow advances to step ST19. Otherwise, the flow returns to step ST20.

In step ST19, controller 216 determines whether convey unit 20 is kept closed. If YES in step ST19, the flow returns to step ST18. Otherwise, the flow advances to step ST12.

In step ST20, if second developing unit 60 which stores the red toner has been selected, copying using unit 60 is performed. However, if first developing unit 58 which stores the black toner has been selected, copying using unit 58 is performed.

With the above arrangement, the same effect as in the previous embodiments can be obtained.

A fourth embodiment of the present invention will be described with reference to FIGS. 17 to 20.

Figure 18:
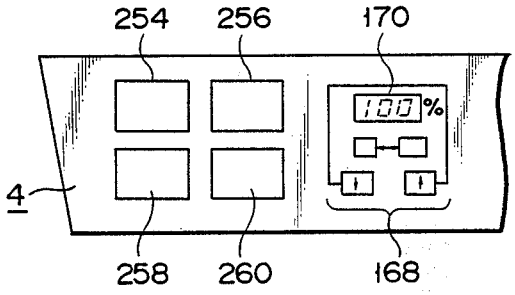
FIG. 18 is a front view of an operation panel in the image forming apparatus shown in FIG. 17.

In this embodiment, four developing units 244 to 250 are supported by frame 252. When frame 252 is rotated, four developing units 244 to 250 are rotated about the axis of frame 252. A desired one of the developing units opposes photosensitive drum 50 and is used for development. Developing unit 244 of units 244 to 250 is used for a black toner, and the remaining units are used for colors different from black. As shown in FIG. 18, selection switches 254 to 260 are arranged in operation panel 4 and are turned on to respectively select developing units 244 to 250, as shown in FIG. 18. In this case, one of the switches is turned on to select a desired developing unit. When one of developing units 244 to 250 is selected by a corresponding one of switches 254 to 260 regardless of the presence/absence of developing color information CD detected by spot sensor 198, the selected developing unit is used for development. Other arrangements in the fourth embodiment are the same as those in the third embodiment.

The operation of the fourth embodiment will be described hereinafter.

Figure 19:
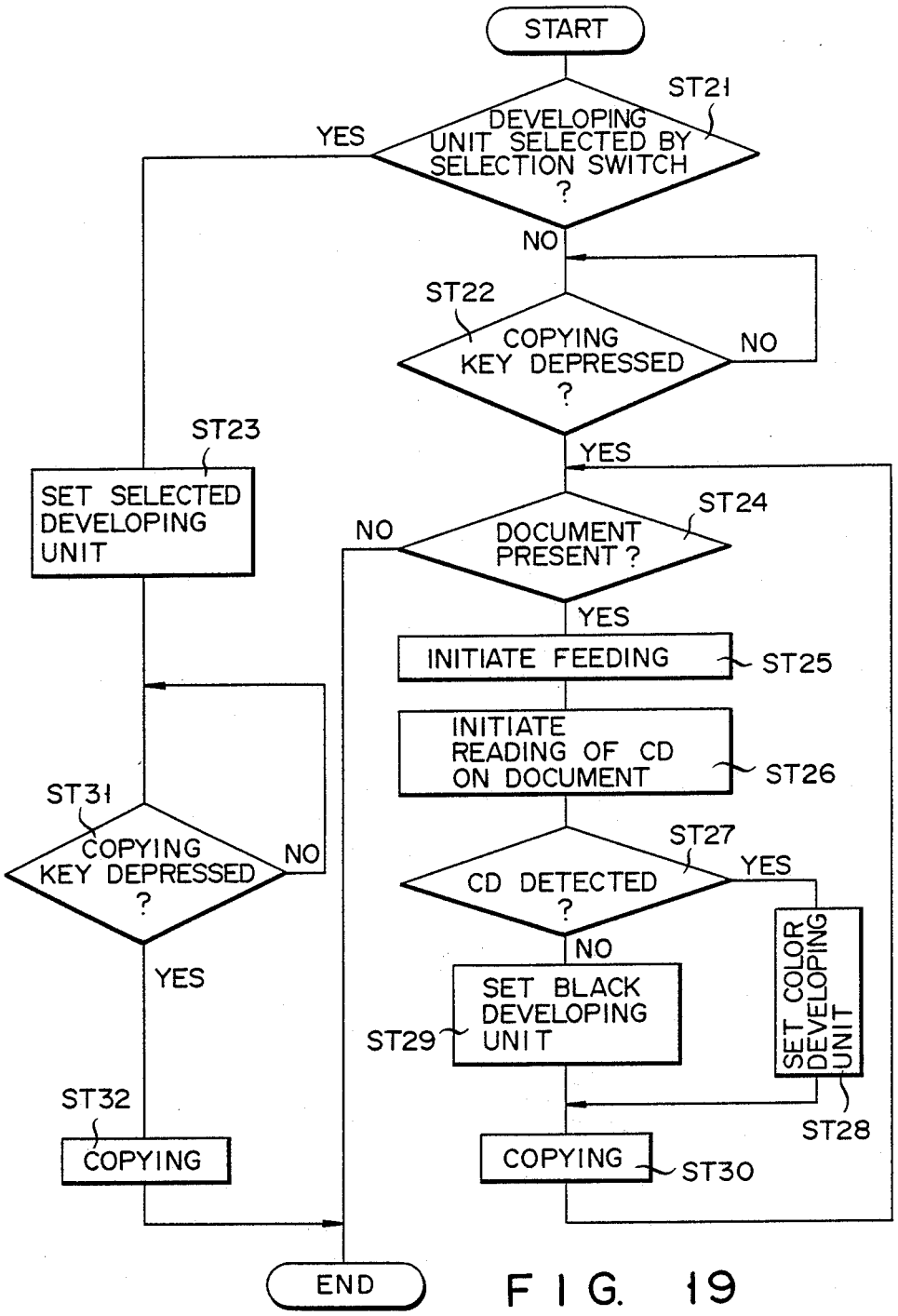
FIG. 19 is a flow chart for explaining the operation in the automatic document feed mode shown in FIG. 17.

In step ST21, if the automatic document feed mode is selected, as shown in FIG. 19, controller 216 determines which one of developing units 244 to 250 is selected by a corresponding one of switches 254 to 260. If no switches 254 to 260 are selected, the flow advances to step ST22. Otherwise, the flow advances to step ST23.

In step ST22, controller 216 determines whether copying key 156 is depressed. If YES in step ST22, the flow advances to step ST24.

In step ST24, controller 216 determines in response to an output signal from document sensor 176 whether the document is present on work table 22 of automatic document feeder 14. If NO in step ST24, the flow is ended. However, if YES in step ST24, the flow advances to step ST25.

In step ST25, separation rollers 180 and aligning rollers 182 are operated to initiate feeding of the document. The flow then advances to step ST26.

In step ST26, reading of developing color information CD of fed document G is initiated by spot sensor 198. More specifically, light-emitting diode 200 is turned on, and light emitted therefrom is incident on the document through lens 202 and window 196. Light reflected by the document is incident on the developing surface of work table 22. The incident light passes through lens 204, half mirror 206, and filters 208 and 210 and is guided to first and second CCD line sensors 212 and 214. Photoelectric output signals from line sensors 212 and 214 are amplified by amplifier 218, and amplified signals are supplied to A/D converter 220 and converted into digital signals thereby. The signal signals are stored in different memory areas of memory 224 through DMA 222. When the document reaches stationary scale 30 of document table 18, the flow advances to step ST27.

In step ST27, light-emitting diode 200 is turned off, and controller 216 determines according to image information stored in memory 224 whether developing color information CD is marked on the document image. More specifically, an addition or subtraction is performed between two pieces of information stored in the memory to detect developing color information CD. As a result, controller 216 determines whether information CD is marked on the document image. As shown in FIG. 10A, if information CD is marked on the image, the flow advances to step ST28. Otherwise, the flow advances to step ST29.

In step ST28, one of developing units 246 to 250 which stores a toner having a color different from black is selected so as to perform color copying. Thereafter, the flow advances to step ST30.

In step ST29, developing unit 244 which stores the black toner is selected. The flow then advances to step ST30.

In step ST30, if one of developing units 246 to 250 which stores a toner except for the black toner is selected, copying using the selected developing unit is performed. In this case, as shown in FIG. 10B, an image of the document shown in FIG. 10B is formed with a toner having a color different from black. Since developing color information CD marked on the document has blue, i.e., a color having a wavelength for providing higher sensitivity of drum 50, information CD is not formed on the sheet. However, if developing unit 244 which stores the black toner is selected, copying using unit 244 is performed. In this case, normal copying is performed. Upon completion of copying, the flow returns to step ST24.

In step ST23, the developing unit selected by one of switches 254 to 260 is set. The flow advances to step ST31.

In step ST31, controller 216 determines whether copying key 156 is depressed. If YES in step ST31, the flow advances to step ST32.

In step ST32, copying with the selected developing unit is performed.

Figure 20:
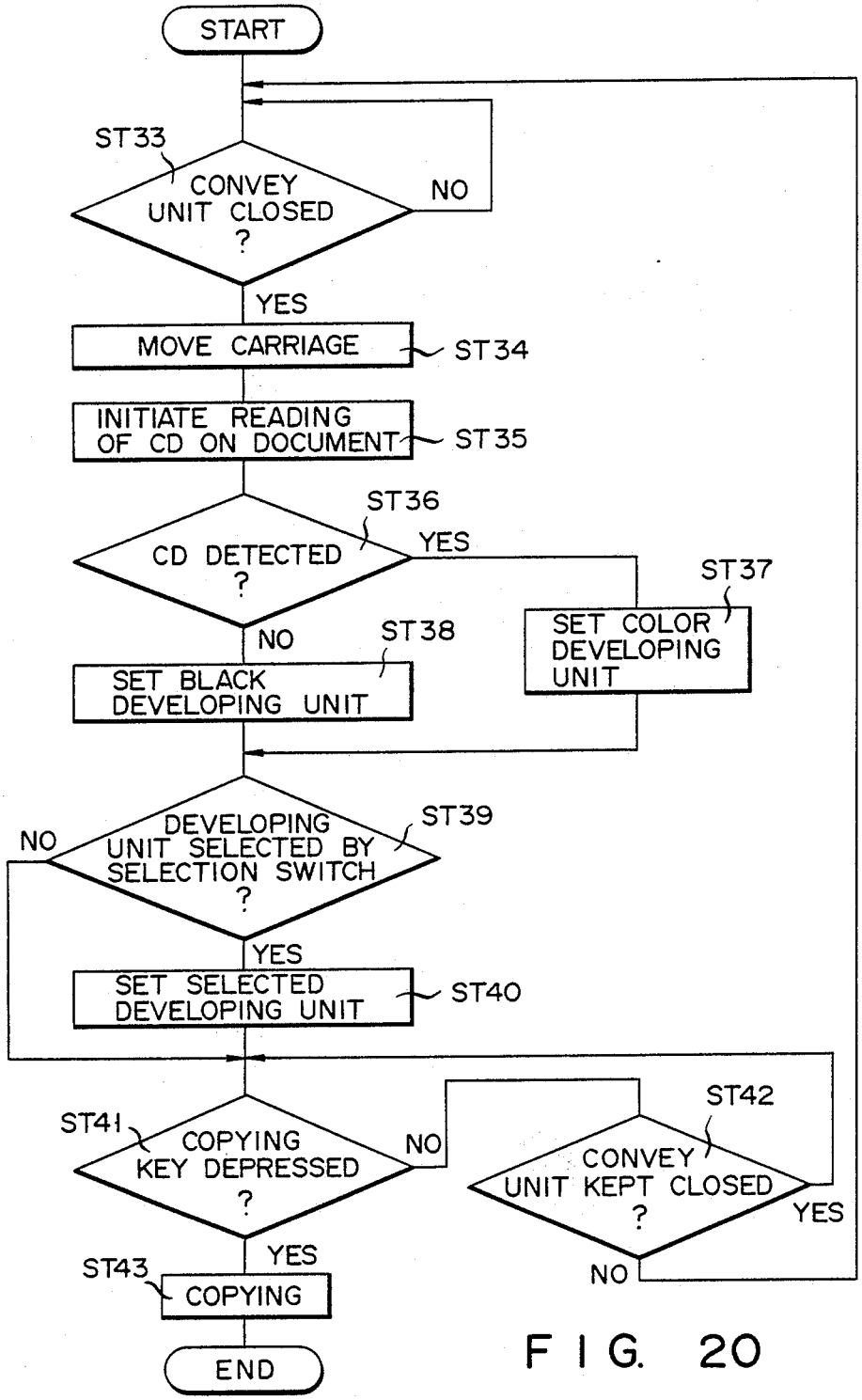
FIG. 20 is a flow chart for explaining the operation in the normal mode of the image forming apparatus shown in FIG. 17.

If the automatic document feed mode is not selected, the normal mode is set as shown in FIG. 20.

In step ST33 of the normal mode, the document is set along stationary scale 30 of document table 18. When convey unit 20 is closed, closing/opening detection switch 242 is turned on by actuator 240. When actuation of switch 242 is detected by controller 216, the flow advances to step ST34.

In step ST34, first carriage 52 is moved from position A to position C near stationary scale 30, as shown in FIG. 14. The flow then advances to step ST35.

In step ST35, light-emitting diode 200 of spot sensor 198 is turned on, and reading of developing color information CD on document G set on document table 18 is initiated. The flow advances to step ST36.

In step ST36, light-emitting diode 200 is turned off, and controller 216 determines according to the reading result whether information CD is marked on the document image. If YES in step ST36, the flow advances to step ST37. However, if NO in step ST36, the flow advances to step ST38.

In step ST37, one of developing units 246 to 250 which stores a toner having a color different from black is selected to perform color copying. The flow then advances to step ST39.

In step ST38, developing unit 244 which stores the black toner is selected, and the flow advances to step ST39.

In step ST39, controller 216 determines whether one of developing units 246 to 250 is selected by a corresponding one of switches 256 to 260. If YES in step ST39, the flow advances to step ST40. Otherwise, the flow advances to step ST41.

In step ST40, the developing unit selected by one of switches 254 to 260 is set. The flow then advances to step ST41.

In step ST41, controller 216 determines whether copying key 156 is depressed. If NO in step ST41, the flow advances to step ST42. Otherwise, the flow advances to step ST43.

In step ST42, controller 216 determines in step ST42 whether convey unit 20 is kept closed. If YES in step ST42, the flow returns to step ST41. Otherwise, the flow returns to step ST33.

In step ST43, if one of developing units 246 to 250 which stores a toner having a color different from black is selected, copying with the selected developing unit is performed. However, if developing unit 244 which stores the black toner is selected, copying with unit 244 is performed.

With the above arrangement, copying of a document image can be conveniently performed by a developing unit selected by one of switches 254 to 260 regardless of a detection state of spot sensor 198.

In the first to fourth embodiments described above, developing color information CD having blue is detected by using gray and blue filters 208 and 210. However, the type of filter and developing color information are not limited to the ones exemplified above. Various changes and modifications may be made.

What is claimed is:

1. An image forming apparatus comprising:

latent image forming means for forming a latent image corresponding to an image of a document, said latent image forming means comprising a photosensitive member, said photosensitive member being arranged such that light corresponding to the image of the document is incident thereon to attenuate a charge after a surface thereof is uniformly charged, thereby forming a latent image on said surface;

a plurality of developing means for developing the latent image using different color agents;

detecting means for detecting developing-color information which is provided on the document and represents one of the color agents to be used for developing the latent image, said developing-color information having a color of a wave length which provides higher sensitivity than that of said photosensitive body and is not formed as a latent image on said surface of said photosensitive body; and selecting means for selecting one of said plurality of developing means on the basis of the developing-color information.

2. The apparatus according to claim 1, wherein at least one of said plurality of developing means develops the latent image with a black color agent and at least one of remaining developing means develops the latent image with a color agent having a color different from black.

3. The apparatus according to claim 2, wherein said selecting means comprises a first support portion for detachably supporting said developing means for developing the latent image with the black color agent and a second support portion for interchangeably supporting said remaining developing means for developing the latent image with color agents having colors different from black.

4. The apparatus according to claim 1, wherein said selecting means selects said developing means using the black color agent when the developing-color information is not detected by said detecting means and selects a developing means using a color agent corresponding to the developing color information when the developing-color information is detected by said detecting means.

5. The apparatus according to claim 1, wherein said latent image forming means comprises a document table on which the document is placed and automatic document feeding means for automatically setting the document on said document table, and said detecting means is arranged in said automatic document feeding means.

6. The apparatus according to claim 5, wherein said automatic document feeding means comprises a feed unit for feeding the document and a convey unit for conveying the document fed from said feed unit and for setting the document on said document table, and said detecting means is arranged in said feed unit.

7. The apparatus according to claim 1, wherein said latent image forming means comprises a document table on which the document is placed, and optical scanning means for optically scanning the document placed on said document table to read the image of the document, and said detecting means is arranged on said optical scanning means.

8. The apparatus according to claim 7, wherein said optical scanning means is movable relative to said document table.

9. The apparatus according to claim 1, wherein said latent image forming means comprises a document table on which the document is placed, automatic document feeding means for automatically setting the document on said document table, and optical scanning means for optically scanning the document placed on said document table to read the image of the document, and said detecting means is arranged on said optical scanning means.

10. The apparatus according to claim 9, wherein said optical scanning means is movable relative to said document table, and said detecting means detects the developing-color information of the document while the document is being fed by said automatic document feeding means.

11. The apparatus according to claim 1, wherein said latent image forming means comprises a document table on which the document is placed, and document table cover means which is freely opened/closed so as to cover the document placed on said document table, and said detecting means comprises means for detecting closing of said document table cover means and detects the developing-color information of the document on the basis of a detection result indicating closing of said document table.

12. The apparatus according to claim 11, wherein said latent image forming means comprises optical scanning means for optically scanning the document placed on said document table to read the image of the document, and said detecting means is arranged in said optical scanning means.

13. The apparatus according to claim 11, wherein said document table cover means comprises automatic document feeding means for automatically setting the document on said document table, said latent image forming means comprises switching means for selecting one of an automatic document feed mode for causing said automatic document feeding means to set the document on said document table and a normal mode for causing an operator to set the document on said document table after said automatic document feeding means is manually opened, and said detecting means detects the developing-color information of the document in response to a document feed timing of said automatic document feeding means in the automatic document feed mode and detects the developing-color information of the document on the basis of closing of said automatic document feeding means in the normal mode.

14. The apparatus according to claim 1, wherein said selecting means comprises selection switches for inputting an instruction to determine which color agent is used to visualize the latent image and selects said developing means on the basis of the instruction regardless of the presence/absence of the developing color information by said detecting means when the instruction is input from a corresponding one of said selection switches.

* * * * *